US011383953B2

(12) United States Patent
Tauber et al.

(10) Patent No.: US 11,383,953 B2
(45) Date of Patent: Jul. 12, 2022

(54) METHOD AND SYSTEM FOR ELEVATING ELEVATOR CARS INCLUDING ALLOCATING ELEVATOR CARS TO SERVE LOAD CALLS

(71) Applicant: Kone Corporation, Helsinki (FI)

(72) Inventors: Ilja Tauber, Helsinki (FI); Ville Wilkman, Helsinki (FI); Lauri Hautaniemi, Helsinki (FI); Vahid Arabzadeh, Helsinki (FI); Jinze Dou, Helsinki (FI); Showmik Dasgupta, Helsinki (FI); Lucky Ogege Eronmosele, Helsinki (FI); Paulo Silva, Helsinki (FI); Diogo Pinto, Helsinki (FI); Sonia Soeiro, Helsinki (FI); Claudia Barradas Fontes, Helsinki (FI)

(73) Assignee: Kone Corporation, Helsinki (FI)

( * ) Notice: Subject to any disclaimer, the term of this patent is extended or adjusted under 35 U.S.C. 154(b) by 1147 days.

(21) Appl. No.: 15/933,839

(22) Filed: Mar. 23, 2018

(65) Prior Publication Data

US 2018/0208429 A1 Jul. 26, 2018

Related U.S. Application Data

(63) Continuation of application No. PCT/EP2015/072936, filed on Oct. 5, 2015.

(51) Int. Cl.

| | |
|---|---|
| ***B66B 1/24*** | (2006.01) |
| ***B66B 1/34*** | (2006.01) |
| ***B66B 1/46*** | (2006.01) |

(52) U.S. Cl.

CPC ..... *B66B 1/2408* (2013.01); *B66B 1/2466* (2013.01); *B66B 1/3461* (2013.01);
(Continued)

(58) Field of Classification Search

CPC . B66B 1/2408; B66B 1/468; B66B 2201/103; B66B 2201/104; B66B 2201/21; B66B 2201/215; B66B 2201/20

See application file for complete search history.

(56) References Cited

U.S. PATENT DOCUMENTS

| | | | | |
|---|---|---|---|---|
| 9,682,843 | B2 * | 6/2017 | Nakagawa | B66B 1/2458 |
| 9,731,934 | B2 * | 8/2017 | Stanley | B66B 1/2408 |

(Continued)

FOREIGN PATENT DOCUMENTS

| | | | |
|---|---|---|---|
| EP | 1764334 | A1 | 3/2007 |
| WO | WO-2015/075304 | A1 | 5/2015 |

OTHER PUBLICATIONS

International Search Report PCT/ISA/210 for International Application No. PCT/EP2015/072936 dated Aug. 4, 2016.

(Continued)

*Primary Examiner* — Christopher Uhlir

(74) *Attorney, Agent, or Firm* — Harness, Dickey & Pierce, P.L.c.

(57) ABSTRACT

An elevator group control device may handle load calls for an elevator system having an elevator car, whereby a load call includes a departure floor, a destination floor, load specification data and a time period which the load is to be transported from the departure floor to the destination floor. The allocating may include reserving a particular portion of the floor area of the elevator car for the load during a portion of the time period, based on the load specification data and the particular portion being available to accommodate the load during the portion of the time period.

16 Claims, 2 Drawing Sheets

(52) U.S. Cl.
CPC ..... *B66B 1/468* (2013.01); *B66B 2201/222* (2013.01); *B66B 2201/405* (2013.01); *B66B 2201/4638* (2013.01); *B66B 2201/4653* (2013.01)

(56) References Cited

U.S. PATENT DOCUMENTS

| | | | | |
|---|---|---|---|---|
| 10,829,342 | B2 * | 11/2020 | Pasini | B66B 11/0005 |
| 2001/0022252 | A1 * | 9/2001 | Schuster | B66B 1/3461 187/382 |
| 2010/0078266 | A1 | 4/2010 | Choi | |
| 2012/0041593 | A1 * | 2/2012 | Ichinose | B66B 1/2458 700/258 |

OTHER PUBLICATIONS

Written Opinion of the International Searching Authority PCT/ISA/237 for International Application No. PCT/EP2015/072936 dated Aug. 4, 2016.

* cited by examiner 12
16
20c
10
20b
20a
18
14
20d
22
28
26
30
24
32
34
34

METHOD AND SYSTEM FOR ELEVATING ELEVATOR CARS INCLUDING ALLOCATING ELEVATOR CARS TO SERVE LOAD CALLS

This application is a continuation of PCT International Application No. PCT/EP2015/072936 which has an International filing date of Oct. 5, 2015, the entire contents of which are incorporated herein by reference.

BACKGROUND OF THE INVENTION

The present invention relates to a method for allocating elevator cars in an elevator system for passenger transport having at least one elevator group with at least one elevator having at least one elevator car. The elevator group is controlled by an elevator group control having a call allocation system to allocate the elevator cars to a floor call using destination call control. The floor call includes the departure floor as well as the destination floor. The elevator system communicates via preferably wireless communication means with terminal devices which are preferably mobile devices such as smartphones. These terminal devices act as a destination operating panel for the passengers for issuing the destination calls. A method of this kind is also known from WO 2015/075304 A1.

SUMMARY OF THE INVENTION

It is object of the present invention to provide a method which allows the handling of load calls in an elevator system for passenger transport in an optimized manner.

The object of the invention is solved via a method according to claim 1 and via an elevator system according to claim 12. Preferred embodiments of the invention are subject-matter of the corresponding dependent claims. Advantageous embodiments of the invention are also described in the description as well as in the drawings.

According to the invention, the call allocation system is configured to handle load calls issued via the terminal device. Such a load call comprises a departure floor, a destination floor, load specification data and first time or time frame within which the load is to be transported from the departure floor to the destination floor. Particularly, such a load call is issued via a mobile device, particularly a smartphone. Thereafter, the allocation system reserves within the first time/time frame the necessary space and/or weight in an elevator car obtained from the load specification data and sends a notice to the terminal device from which the load call has been issued and/or to a predetermined terminal device. This notice comprises information that currently or at what time an elevator car is going to serve the load call and which elevator car is going to serve the load call.

Thus, the invention handles in an optimized manner the allocation of passenger calls as well as of load calls in a way that facilitates load transportation in an environment. Furthermore, the elevator car space is optimally used by reserving an amount of space in the elevator car which is really necessary to take up the load according to the load specification data. Therefore, the handling of the load specification data is an essential factor in evaluating how much space has to be reserved for the load call. Thus, the invention optimizes elevator traffic by asking the user of an elevator system to which floor he is going and how much load is going to be transported. As the information input is performed via terminal devices which are preferably smartphones held by the single users of the elevator system, such a system can be easily embedded into an existing elevator system via a corresponding application of the smartphone. It is principally possible that when an elevator car is going to be allocated to the load call, the user who is issued the load call gets a notice from the elevator system. Anyway, it may be possible that for the load transport, a certain department, for example a wear handling department, is responsible so that the notice is given to this department. Accordingly, it is not necessary that the person issuing the load call accompanies the load transport. It is further possible to give notice to a preselected number of terminals, e.g. the ware handling department, the janitor and the person who has given the load call via his smartphone. It is further possible that the terminals to be notified when the load call is issued can be input via the terminal device of the user who has issued the load call.

Following terms are used as a synonym: terminal=terminal device

Preferably, the call allocation system comprises a forecast section and the call allocation system considers the allocation of the load call only in a second time frame within the first time frame, whereby the total traffic of the elevator system in the second time frame is according to the traffic forecast section expected to be lower than in the remaining period of the first time frame. Via this measure, the load call can be allocated in a period which is to be expected a comparably low traffic period. By this means, the allocation of the load call does not essentially affect the capacity of the elevator system for the passenger transport. Therefore, load calls can be handled in a smooth way.

In a preferred embodiment of the invention, the call allocation unit calculates from the load specification data a space and/or weight portion of an elevator car to be reserved for the load call. It is principally possible that the user itself inputs as load specification data a portion of an elevator car. This would however require that the user is aware of the dimensions of the elevator car. Therefore, it is preferable that the user only inputs the size and/or weight of the load to be transported and the call allocation system itself calculates from this load specification data a portion of the elevator car to be reserved for the load call from the elevator systems internal data about the size of the elevator car and the geometry thereof. This is important as when the load size for example requires a third of a cabin, it is not said that the remaining ⅔ of the elevator car is really usable by passengers. Thus, although the size portion of the load is only one third of the elevator car, it is possible that the load when placed in the elevator car really necessitates the half of the elevator car. The call allocation system is able to consider these facts by an internal calculation algorithm which calculates from the size and/or weight of the load to be transported the place in the elevator car which has really to be reserved and is not usable by passengers for passenger calls.

In a preferred embodiment of the invention, the call allocation system excludes at least in a part of the first time frame the space and/or weight of the elevator car which is to be reserved for the load call from the elevator car space available for passenger calls. This method can for example be used when the current time gets near to the end of the first time frame and still the issued load call has not been served. In this case, the load call obtains highest priority by simply excluding the space portion in the elevator car from the elevator car space which is available for passenger call allocation. By this measure it can be ensured that the load call is by any means served within the first time or first time period.

It is generally possible that a load call has to be served within a first time frame which lies in a period of high elevator traffic. Particularly, in this case, it is preferable when the call allocation system divides the load according to the load specification data into several smaller partial loads if within the first time frame there is no space for the load available in a single elevator car, whereby in this case a notice is sent to the terminal of the person who has issued the load call and/or to the predetermined terminal informing of the division of the load transportation into several sub-loads. Of course, the load specification data should in this case comprise information whether or not the load can be divided into partial loads and eventually into how many loads it can be divided. Via this measure, a load call can be handled smoothly even in times of high elevator traffic without hampering the passenger transport which has usually a higher priority than the load transport.

In a preferred embodiment of the invention, the load call is handled in a call allocation procedure comprising an optimization unit in which a cost function is used for each of a variety of calculated allocation solutions to evaluate the fitness of said allocation solution for the current call situation. In this cost function, several weighted passenger transportation parameters together with their correlated weight coefficients are considered. Such passenger transportation parameters are for example passenger waiting time, passenger riding time, total travel time, energy consumption, etc. According to the invention, in this cost function, a load transportation parameter is added as a further parameter, which load transportation parameter is correlated with a corresponding load weight coefficient. By this measure it is possible to introduce the load call allocation in a selectable priority to the other relevant transportation criteria for passenger transport, whereby the priority is selected via the load weight coefficient. By choosing the load weight coefficient accordingly, for example to be higher or larger than the other weight coefficients of the passenger transportation parameters, the load call can get a higher priority in the call allocation than the passenger transportation parameters. Therefore, this measure is a very convenient way to introduce the handling of load calls in the call allocation with a desired priority.

In a preferred embodiment of the invention, the load weight coefficient is made dependent on the first time frame, particularly on the remaining time of the first time frame. If for example the first time frame is a very short period, for example 5 minutes, the load weight coefficient can be set very high as to ensure that the load call is really served within the next 5 minutes. If, on the other hand, the time frame is for example 3 hours, the load weight coefficient can be held correspondingly low so that the load call is only served when no transportation capacity for the passenger transport is needed. On the other hand, the load weight coefficient can be held variable so that it is low at the begin of the first time frame and increases in the direction to the end of the first time frame so that towards the end of the first time frame, the priority of the load call becomes increasingly higher. Also this way is a convenient measure to ensure the serving of the load call within the first time frame in a smooth manner as to minimize the hampering of passenger call allocation by the load call.

In a preferred embodiment of the invention, when time threshold before the end of the first time period is obtained, the load call is allocated to the next elevator moving to the departure floor and having enough space for the load. This measure is a kind of urgency measure which is only used if the load call is not served within the first time frame and the current time runs towards the end of the first time frame without the load call being served. Thus, before arriving at said time threshold the load call is considered in the optimization algorithm within the cost function as mentioned above and only if the time threshold is achieved, which is e.g. 1 minute before the end of the first time frame, the load call is automatically reserved for the next elevator car which is getting to or passing the departure floor and has enough space to pick up the load. This means that in this case, the priority of serving the load call is set above all passenger load calls as to ensure the serving of the load call within the first time frame.

Whereas it is possible that the terminal devices are terminals which are connected via wire, for example LAN, to the elevator group control, it is preferable that the elevator system communicates wirelessly with the terminal devices because in this case, smartphones owned by the users of the environment may be used as terminal devices which reduces the hardware effort of the elevator building or building owner and offers a wide variety of options as the communication with the wireless mobile devices can be managed via an application (App) loaded at the smartphone and thus the functionality and interaction with the elevator system can be configured via software.

The terminal device may be also a standalone DOP (destination operating panel) using preferably wireless communication. These DOPs can be located preferably at elevator lobbies or in defined places in the environment known to the users to order material/articles. Furthermore, such a DOP could be located in a ware handling department dealing with material orders.

When giving a load call, the user may select materials/articles from a material/article list displayed on the terminal device display and then specify an amount of selected materials/articles. In this preferred embodiment the DOP is also configured to display material/articles which can be ordered by users of the elevator group. The elevator system, preferably its group control is then preferably configured to calculate from the ordered materials/articles the corresponding space needed in the elevator car. In this case the elevator system preferably has a memory with a table specifying the dimensions and/or weight of the displayed materials/articles. The elevator group control can thus be involved in the process of material order which might be beneficial preferably in the building stage of an environment, when the at least one elevator of the elevator group is preferably used for material transports for the workers working at the building site.

Thus, in a preferred embodiment the material/article list is user specific (for example painters may have their own list of available paints whereas construction workers have a different one with construction materials). The user specific lists may be generated by the elevator system, preferably its group control, preferably its call allocation system based on user identification, given when using the terminal device. In case the terminal device is one (e.g. smartphone) owned by the user this might be an ID of the terminal device or the smartphone number.

In this connection the elevator group control can also be integrated or connected with an environment service control system which handles service matter with regard to the environment (e.g. a residential or office building, a mall, an airport etc.).

Preferably, the elevator group control or its call allocation system is configured to calculate the space/load needed for a material/article order, preferably based on information of the displayed material/articles.

Normally, an elevator group to minimum comprises at least two elevators, but typically in the beginning of construction work on a building the group may consist of only one working elevator.

Preferably, passenger destination calls as well as the load calls are input via the terminal device and an allocated elevator is displayed via said terminal device before the arrival of the elevator car at the departure floor, preferably quite immediately after having issued the call. Via this measure, the terminal device or smartphone cannot only be used as an input means for the destination call system of the elevator group but it can additionally be used as a display for indicating the allocated elevator and/or the location of the allocated elevator in the environment.

The invention also relates to an elevator system comprising at least one elevator group with at least one elevator having at least one elevator car. Thus, an elevator may for example have two cars within one shaft. Further, the elevator system comprises at least one elevator group control comprising a call allocation system which is configured to allocate elevator cars in response to floor calls. Further, the elevator system comprises communication means to communicate with passenger held terminal devices serving as destination operating panels for issuing the floor calls and displaying the allocated elevator car. Such a destination controlled elevator system is known from WO 2015/075304 A1. According to the invention, the call allocation system has a load call allocation section being configured to handle load calls which comprise a departure floor, a destination floor, load specification data, and a first time/time frame wherein a load is to be transported from the departure floor to the destination floor. Furthermore, the call allocation system is configured to reserve within the first time or time frame an available space in at least one of the elevator cars for the load to be transported, and the call allocation system is configured to issue a notice to the terminal device where the load call has been issued and/or to a predetermined terminal device via the communication means, that or at what time an elevator car is arriving at the departure floor to serve the load call, and which elevator car is to serve the load call.

This elevator system solves the problem of optimizing the usage of elevator car space as the elevator system gets load call information comprising the size and/or weight of the transported load and is thus able to calculate the needed space portion in the elevator car serving the load call. Furthermore, the elevator system is free to handle the load call with a desired priority with respect to the pending passenger calls. The other advantages and essential point of this inventive elevator system are essentially the same as with the inventive method described above.

As terminal devices preferably mobile devices, particularly smartphones, are used and the input of the load specification data can for example be realized by a sliding button as a portion of the size of an elevator car or by inputting the real dimensions and/or weight of the load to be transported. By this measure, the input of the load specification data can be simplified even for users unfamiliar with said technology.

Of course, it is possible that the load calls are handled as normal passenger calls in the call allocation system within the normal optimization unit. Preferably, the call allocation system comprises an optimization unit designed to calculate the value of a cost function for different route alternatives for a given call situation, which cost function comprises a sum of passenger travel parameters provided with corresponding weight coefficients such as for example passenger riding time, passenger waiting time, total travelling time, energy consumption. The optimization unit is further designed to extend this cost function by a load parameter correlated with a corresponding load weight coefficient which is at least towards the end of the first time or time frame larger than the weight coefficients of the passenger travel parameters to ensure that the load call is served within the indicated first time period.

This kind of handling the load calls smoothly adds the load calls with separate parameters into the cost function which leaves it open to the owner of the elevator system with what priority (load weight parameter) the load calls have to be served with respect to passenger calls. On the other hand, by holding the load parameter variable it is possible to increase the priority of the load call towards the end of the first time period to ensure the handling of the load call within the first time period.

On the other hand, this inventive elevator system also meets the need of reserving space for a future transportation, as it is possible that the first time frame does not begin immediately after issuing the load call but begins in the future, for example 3 hours later. Therefore, the elevator system stores this load call and adds the load call to the call allocation only with the begin of the first time frame. Therefore, the invention shifts some responsibility for the organization of the load transportation to the elevator system which is very convenient for the users of the system. By corresponding measures as for example time thresholds before the end of the first time period, it can also be ensured that even in unfortunate traffic conditions the load call is in any case served within the first time period.

Preferably, the communication means of the elevator system are wireless communication means which means e.g. short range transmission means as e.g. Bluetooth® or a public telephone network.

Although it is possible that the user directly inputs as load specification data a portion of the area of the elevator car it is preferable that the user issues with the load call only the dimensions of the load and/or its weight and the call allocation system calculates from this load specification data a portion of the elevator floor area to be reserved for the load call. This facilitates the specifying of a load call also for persons which are not aware of the dimensions of the elevator cars in the elevator system.

It shall be clear for the skilled person that the features of the claims can be single components or can be multiple components which are provided as single unit or are provided manifold over the complete elevator systems or which are distributed among different components of the elevator system. Accordingly, the call allocation system can be a module of the elevator group control and the elevator group control can be a portion of an elevator multi-group control. Also the call allocation system can be located in the elevator multi-group control.

The system of the invention has essential advantages as for example a construction site worker that needs some materials from a different floor could use the smartphone to order these materials to be delivered directly to his floor and specify the dimensions of the materials to be ordered and a maximum time frame during which his material request is still relevant. The periods, i.e. the first time frame, can also begin in the future so that the allocation is considered only at a later time, for example beginning in the 3 hours or 4 hours. Given these two informational inputs, load size and time frame, it would be possible for the elevator system to decide how much of each elevator ride should be filled up with passengers travelling up and down and how much of the elevator car space should be allocated to a specific material order whereby it of course doesn't have to be the next elevator car after the worker has placed his order. The first time frame may for example also a quite large time frame for example of 6 hours. This allows the elevator system to wait for the most optimal elevator ride for the material order considering the total burden or hampering of passenger transportation capacity of the entire elevator system.

By allowing the user to specify the needed space for people and material separately, the system can decide whether there is going to be room for other passengers or materials. In addition to this kind of data collection, the elevator car could be provided with sensors or cameras to monitor the space usage in real time to avoid miss-usage.

A further requirement for the elevator system may be the necessity of the user issuing the load call to identify himself when the load call is issued for example via his smartphone ID or his smartphone number in which case the user who has issued the load call can be easily held responsible for any misuse.

In addition to the previously described use case, the invention can also be used during construction whereby it can basically be used in any building with high traffic of passengers as well as of goods for instance in hospitals or high-rise hotels. In this case, the separation of passenger space and load space in the elevator cars could be optimized.

One of the key aspects of the invention is that it allows to estimate the amount of the elevator car space used by the load of a load call and correspondingly consider this data in the load allocation process. Furthermore, the elevator system is able not only to consider the dimensions of the load but also the weight as to find a solution which does not affect the operation of the elevator itself which might be possible with very heavy loads. The invention thus provides an optimized co-transportation of passengers as well as goods with an optimized elevator car use.

BRIEF DESCRIPTION OF THE DRAWINGS

The invention is hereinafter described via the aid of an embodiment in the schematic drawing. This shows a diagram of an elevator system for the handling of passenger calls and load calls, FIG. 1 a diagram of an elevator system for the handling of passenger calls and load calls.

DESCRIPTION OF THE PREFERRED EMBODIMENTS

Figure 1:
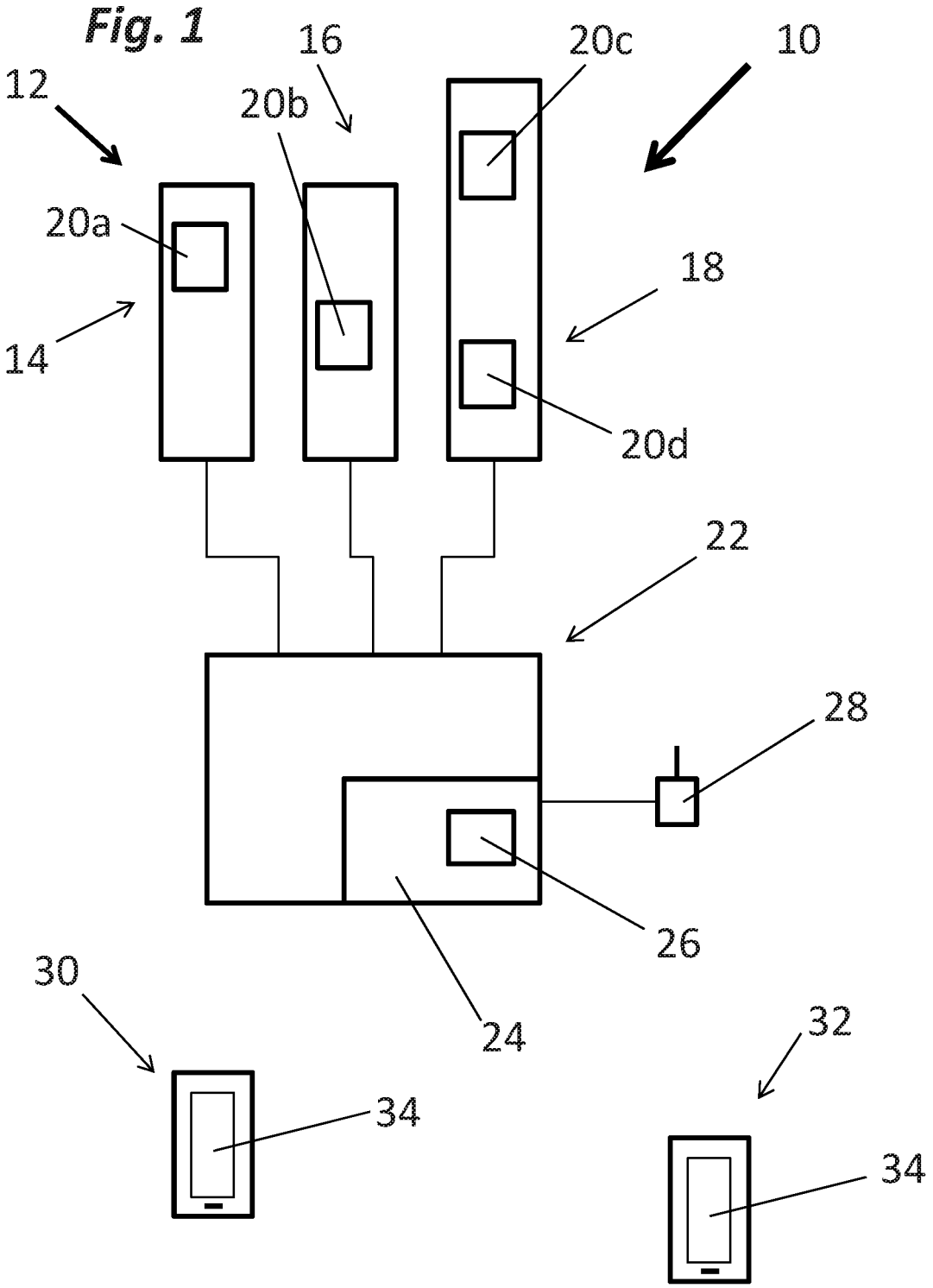

FIG. 1 shows an elevator system 10 having an elevator group 12 consisting of three elevators 14, 16, 18 each elevator having one or two elevator cars 20*a*-20*d* wherein the third elevator 18 has two elevator cars 20*c*, 20*d* travelling together in one elevator shaft. The three elevators 14, 16, 18 of the elevator group 12 are connected to an elevator group control 22 which comprises a call allocation system 24 which again comprises an optimization unit 26. The elevator group control 22 is connected to a communication means 28 which can also be an integral part of the elevator group control 22. The communication means 28 allows the communication of the elevator group control 22 via a public telephone network. Furthermore, the elevator system 12 comprises terminal devices 30, 32 preferably embodied as smartphones and comprising a touch screen 34 which is able to operate as an input means as well as a display.

The elevator system according to FIG. 1 works as follows.

A user may issue via a first smartphone 30 a load call wherein he informs the elevator system that he (on the $22^{nd}$ floor) wants to obtain a material order from the base floor within the next 1 to 3 hours. Furthermore, the user specifies the size of the material to be ordered by 0.5 m×0.5 m×1 m (width×depth×height). In a different embodiment the user may select material/article from a material/article list displayed on the terminal device display, e.g. his smartphone, and then give the amount of selected material/articles. In this preferred embodiment the terminal device (smartphone) is also configured to display material/articles which can be ordered by users of the elevator group. The elevator system, preferably its group control then calculates from the ordered materials/articles the necessary space to be reserved in the elevator car. The elevator system 22 stores this load call and feeds it to the call allocation system 24 after 1 hour, i.e. the beginning of the first time frame. The call allocation system 24 calculates from the load specification data an area of the elevator car to be reserved for the load call and allocates an elevator car to serve the load call whereby a notification is given to the first smartphone 30 of the user who has given the load call as well as to a second smartphone 32 of the mail order worker of the environment located in the basement of the environment and who is responsible for material orders. Thus, the sender of the load call, namely the worker in the material handling and mail order department, as well as the recipient of the material order, namely the user who has issued the load call, are informed in time when the load has to be brought to the allocated elevator and when then allocator with the load is to be expected at the destination floor. The fact that the first time frame is freely selectable makes the handling of the load transport in the elevator system very smooth as it can for example be specified by according selection of the first time frame in a period where the traffic in the elevator system is low.

Figure 2:
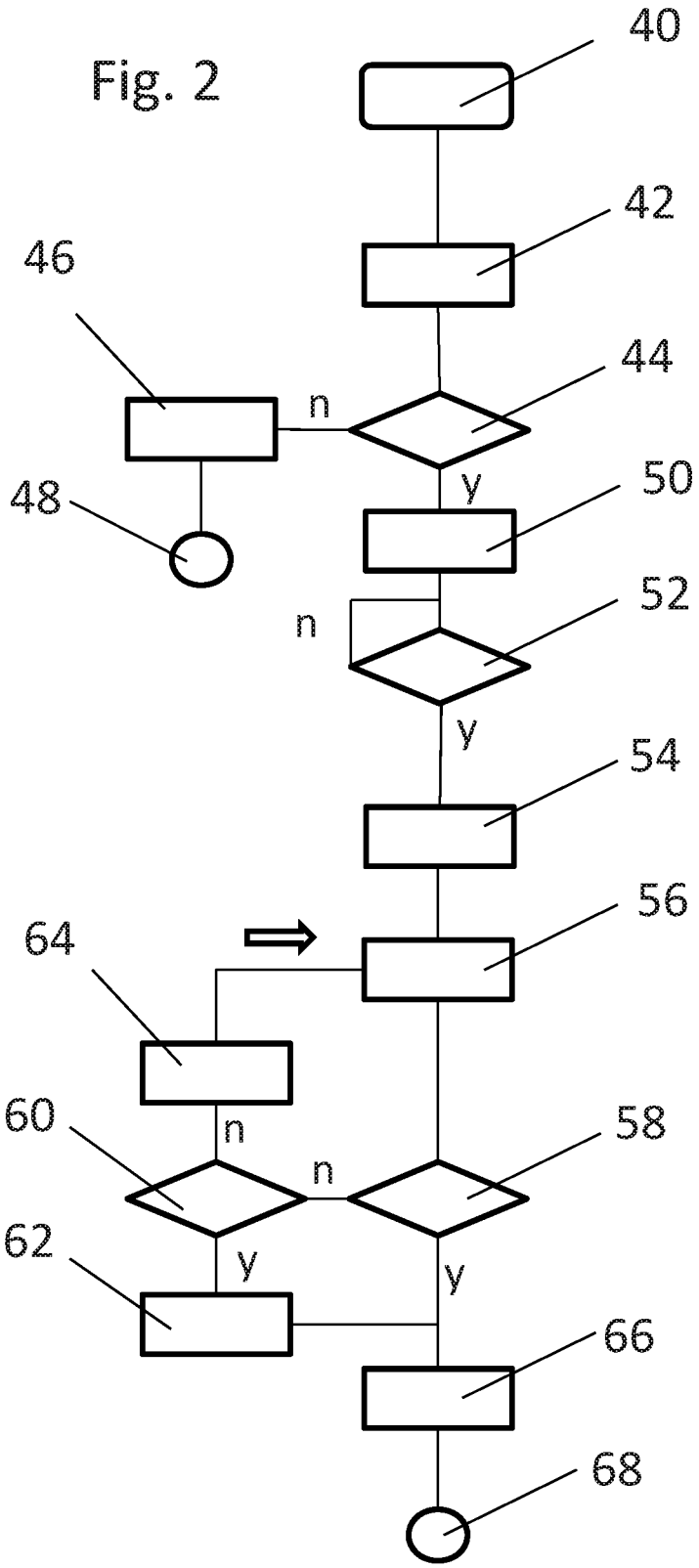
FIG. 2 a flow diagram for the handling of a load call in a call allocation process.

FIG. 2 shows a flow-chart of the handling of a load call in the call allocation system 24.

At start step 40, a load call is input via the first smartphone 30 into the elevator system 10. In step 42, first, the elevator car portion necessary to serve the load call is calculated and in the deciding step 44 it is checked whether the load fits into at least one elevator car of the elevator system. If the answer is no, the load call is rejected in step 46 which is notified to the first smartphone 30 of the user who has issued the load call. The routine then goes to the end 48.

If the load fits into the elevator car, the load call is confirmed in step 50 which is notified to the first smartphone 30 who has issued the load call. Now in the deciding step 52 it is checked whether the current time already passes the begin of the first time frame. If not, the process repeats this step until the begin of the first time frame. After the begin of the first time frame the load weight parameter is set to an initial value in step 54 and the load call is considered in the load call allocation in an optimization process in step 56. In deciding step 58 it is asked whether the load has already been allocated. If the answer is no, it the process leads in a further deciding step 60 in which it is checked whether a time threshold (indicating the running out of the first time period has been achieved as to ensure the allocation of the load call within the first time frame. If this time threshold has been achieved, the next elevator car with enough car space which is travelling to or passing by the departure floor is allocated to the load call in step 62, whereafter in step 66, the first smartphone 30 as well as the worker in the material order department 32 are notified about the car arrival time at the departure floor and about the allocated elevator whereafter the procedure ends in step 70. If in step 60 the time threshold is not achieved, the load weight parameter is increased after a certain time and the process returned to allocation step 56.

Via this handling of a load call it is on one hand achieved that load calls are smoothly handled within the predominant passenger calls of the elevator system but are on the other hand handled in time within the boundaries of the first time frame.

The invention is not delimited to the described embodiment but it can be varied within the scope of the appended patent claims.

LIST OF REFERENCE NUMBERS

10 elevator system
12 elevator group
14 first elevator
16 second elevator
18 third elevator
20*a-d* elevator cars
22 elevator group control
24 call allocation system
26 optimization unit
28 communication means
30 first smartphone
32 second smartphone
34 touchscreen
40 input load call via smartphone
42 calculation of elevator car portion from load specification data
44 load fits in elevator car?
46 rejection of load call
48 end
50 confirmation of load call to smartphone
52 begin of first time frame?
54 set load weight parameter to initial value
56 consider load call in call allocation
58 has load call been allocated?
60 time threshold achieved?
62 allocate next elevator with enough space
64 increase load weight parameter after time span (clock)
66 notify car arrival time at departure floor and allocated elevator via smartphone
68 end

The invention claimed is:

1. A method for allocating an elevator car in an elevator system for passenger transport, the method comprising:

receiving a load call via a communications interface, the load call including information indicating a departure floor, a destination floor, load specification data associated with a load, and a time period wherein the load is to be transported from the departure floor to the destination floor;

allocating the elevator car to serve the load call, to prioritize the elevator car to serving the load call over serving another load call within the time period, the allocating including reserving a particular portion of a floor area of the elevator car for the load during a portion of the time period, based on the load specification data and the particular portion being available to accommodate the load during the portion of the time period, and causing the elevator car to, within the portion of the time period and subsequently to reserving the particular portion of the floor area of the elevator car for the load during the time period, first move to the departure floor to accept the load within the particular portion of the floor area of the elevator car and subsequently move from the departure floor to the destination floor to enable offloading of the load from the particular portion of the floor area of the elevator car at the departure floor; and transmitting a notice to a terminal device via the communications interface based on the allocating, the notice indicating the elevator car as a particular elevator car that is to serve the load call during the time period, arrival of the elevator car at the departure floor to serve the load call, or a combination thereof, wherein the load specification data indicates that the load is configured to be divided into a plurality of partial loads, the allocating includes dividing the load according to the load specification data into the plurality of partial loads, based on a determination that, within the time period, there is no space for the load available in a single elevator car, and the method further includes transmitting a separate notice to the terminal device, the separate notice indicating the dividing.

2. The method according to claim 1, wherein the portion of the time period is a limited portion of the time period; and the reserving reserves the particular portion of the floor area of the elevator car for the load during the portion of the time period based on a determination that total traffic in the elevator system during the portion of the time period is less than total traffic during a remaining period of the time period.

3. The method according to claim 1, wherein the allocating includes calculating a space/weight portion of the elevator car based on processing the load specification data, and reserving the particular portion of the floor area of the elevator car based on the calculated space/weight portion.

4. The method according to claim 1, the terminal device is a mobile device.

5. The method according to claim 1, wherein the reserving excludes the particular portion of the floor area of the elevator car from being available to accommodate one or more passengers during the portion of the time period.

6. The method according claim 1, wherein the allocating includes calculating separate, respective cost function values of a cost function associated with different allocation solutions to serve the load call, and comparing the cost function values of the different allocation solutions to select one allocation solution of the different allocation solutions as a most fit allocation solution to serve the load call, the cost function based on a plurality of weighted passenger travel parameters that are correlated with travel weight coefficients and a load transportation parameter that is correlated with a load weight coefficient.

7. The method according to claim 6, wherein the allocating reserves the particular portion of the floor area of the elevator car based on a determination that the elevator car is a next elevator car moving to the departure floor during the time period after a time threshold value within the time period.

8. The method according to claim 6, wherein the load weight coefficient has a value that varies according to remaining time of the time period.

9. The method according to claim 1, wherein the transmitting includes communicating with the terminal device.

10. The method according to claim 1, wherein the receiving receives the load call from the terminal device via the communications interface, and the terminal device is configured to display an indication that the elevator car is allocated to serve the load call prior to arrival of the elevator car at the departure floor.

11. An elevator system, comprising an elevator group including an elevator, the elevator including an elevator shaft and an elevator car configured to move within the elevator shaft, the elevator car having a floor area;

a communications interface configured to communicate with a terminal device; and an elevator group control device configured to receive a load call via the communications interface, the load call including information indicating a departure floor, a destination floor, load specification data associated with a load, and a time period wherein the load is to be transported from the departure floor to the destination floor, allocate the elevator car to serve the load call, to prioritize the elevator car to serving the load call over serving another load call within the time period, the allocating including reserving a particular portion of the floor area of the elevator car for the load during a portion of the time period, based on the load specification data and the particular portion being available to accommodate the load during the portion of the time period, and causing the elevator car to, within the portion of the time period and subsequently to reserving the particular portion of the floor area of the elevator car for the load during the portion of the time period, first move to the departure floor to accept the load within the particular portion of the floor area of the elevator car and subsequently move from the departure floor to the destination floor to enable offloading of the load from the particular portion of the floor area of the elevator car at the departure floor, and transmit a notice to the terminal device via the communications interface based on the allocating, the notice indicating the elevator car as a particular elevator car that is to serve the load call during the time period, arrival of the elevator car at the departure floor to serve the load call, or a combination thereof, wherein the load specification data indicates that the load is configured to be divided into a plurality of partial loads, the allocating includes dividing the load according to the load specification data into the plurality of partial loads, based on a determination that, within the time period, there is no space for the load available in a single elevator car, and the elevator group control device is configured to transmit a separate notice to the terminal device, the separate notice indicating the dividing.

12. The elevator system according to claim 11, wherein the terminal device is a mobile device.

13. The elevator system according to claim 11, wherein the communications interface is a wireless network communication interface.

14. The elevator system according to claim 11, wherein the allocating includes calculating separate, respective cost function values of a cost function associated with different route alternatives to serve the load call, the cost function including a sum of passenger travel parameters and corresponding passenger travel weight coefficients, and extending the cost function by a load transportation parameter correlated with a corresponding load weight coefficient, the load weight coefficient having a value that varies according to remaining time of the time period, such that the load weight coefficient has a greater value than the passenger travel weight coefficients at an end of the time period, and allocating the elevator to the load call such that the elevator car serves the load call according to a selected route alternative of the different route alternatives, the selected route alternative being selected based on comparing the separate, respective cost function values of the different route alternatives.

15. The elevator system according to claim 11, wherein the elevator group control device is further configured to calculate the particular portion of the floor area of the elevator car based on the load specification data.

16. The elevator system according to claim 11, wherein the terminal device is configured to operate as a destination operating panel.

* * * * *